US010690452B2

(12) United States Patent
Citterio

(10) Patent No.: US 10,690,452 B2
(45) Date of Patent: Jun. 23, 2020

(54) BALLISTIC PROTECTION WITH MULTI-LAYERED STRUCTURE INCLUDING A PLURALITY OF RIGID ELEMENTS

(71) Applicant: F.LLI CITTERIO SPA, Monza (IT)

(72) Inventor: Giorgio Celeste Citterio, Monza (IT)

(73) Assignee: F.LLI CITTERIO SPA, Monza (IT)

( * ) Notice: Subject to any disclaimer, the term of this patent is extended or adjusted under 35 U.S.C. 154(b) by 656 days.

(21) Appl. No.: 14/910,426

(22) PCT Filed: Aug. 12, 2013

(86) PCT No.: PCT/IT2013/000225
§ 371 (c)(1),
(2) Date: Feb. 5, 2016

(87) PCT Pub. No.: WO2015/022708
PCT Pub. Date: Feb. 19, 2015

(65) Prior Publication Data

US 2016/0178328 A1 Jun. 23, 2016

(51) Int. Cl.
*F41H 5/04* (2006.01)

(52) U.S. Cl.
CPC ..... *F41H 5/0485* (2013.01)

(58) Field of Classification Search
None
See application file for complete search history.

(56) References Cited

U.S. PATENT DOCUMENTS 6,003,424 A 12/1999 Cordova et al.
6,127,291 A 10/2000 Coppage, Jr. et al.
(Continued)

FOREIGN PATENT DOCUMENTS

CA 1240604 A 8/1988
CA 2702117 A1 4/2009
(Continued)

OTHER PUBLICATIONS

Menier, Renan, "International Search Report," prepared for PCT/IT2013/000225, dated Apr. 30, 2014, four pages.

*Primary Examiner* — Arti Singh-Pandey
(74) *Attorney, Agent, or Firm* — Winstead PC

(57) ABSTRACT

The ballistic structure for personal protection according to the present invention includes a plurality of rigid structures, separated from one another, in which at least one rigid element is formed by layering of leaves made of high molecular weight polyethylene tapes arranged in parallel and unidirectional fashion wherein these leaves are cross-plied and pressed at high temperature, with adhesive polymers being laid down on at least one face of the single leaves, and in which at least another rigid element is formed by a layering of unidirectional resin-impregnated yarns, wherein each layer of unidirectional yarn is crossed with the subsequent one. Such layering is pressed at high pressure and at high temperature. In a preferred embodiment, the rigid structure, which is the first to be impacted by the bullet, is made of a rigid element composed of ultra high molecular weight polyethylene yarn. The values of trauma obtained by the bullet impact are considerably reduced with respect to a monolithic layering of the same weight.

13 Claims, 2 Drawing Sheets

(56) References Cited

U.S. PATENT DOCUMENTS

| | | | | |
|---|---|---|---|---|
| 2011/0168003 | A1* | 7/2011 | Kim | F41H 1/02 89/36.02 |
| 2012/0085224 | A1* | 4/2012 | Jongedijk | B29C 43/003 89/36.02 |
| 2015/0082976 | A1* | 3/2015 | Meldner | F41H 1/02 89/36.02 |

FOREIGN PATENT DOCUMENTS

| | | | |
|---|---|---|---|
| CA | 2820423 | A1 | 6/2012 |
| CA | 2852906 | A1 | 7/2013 |
| CN | 102015282 | A | 4/2011 |
| RU | 2367881 | C1 | 9/2009 |
| RU | 2420704 | C1 | 6/2011 |
| WO | WO-2006124825 | A2 | 11/2006 |
| WO | WO-2009133150 | A1 | 11/2009 |
| WO | WO-2013021401 | A1 | 2/2013 |

* cited by examiner

BALLISTIC PROTECTION WITH MULTI-LAYERED STRUCTURE INCLUDING A PLURALITY OF RIGID ELEMENTS

TECHNOLOGICAL FIELD

The present invention relates to a structure for making ballistic protections, in particular, a multilayer structure that combines separate rigid elements.

BACKGROUND

In the field of ballistic protections there are known textile structures that stop bullets fired from a gun; they are mainly made of fibers having high breaking strength and textile structures that include, for example: weft-and-warp fabric, unidirectional fabric, multiaxial fabric etc. These structures can be used for making rigid or flexible ballistic protections, in accordance with the type of the bullet to be stopped.

It is very important that the ballistic structures aimed at protecting persons not only stop the bullet, but it is likewise important that the bullet impact (and the subsequent deformation that results therefrom) not cause values of trauma to the wearer: such values of trauma, when exceeding a tolerance threshold, could be fatal or in any case, do not allow the wearer to promptly react to the attack, due to the high shock absorbed by the human body.

Flexible structures are mainly used in civil or paramilitary fields for the protection against the bullets fired by hand-guns. Such bullets are easily deformable and consequently, are easier to be stopped, also the correlated energy and speed are generally lower than about 1500 Joules and 500 m/sec.

These flexible structures are often associated with rigid structures, of generally smaller dimensions, if the risk scenario includes also the protection against the bullets fired from a rifle, which are difficult to deform and have energy even higher than 4000 Joules and speed higher than 1000 m/sec.

Such compound structures are obviously heavy and do not allow the wearer to react promptly.

According to solutions known in state of the art, for example that described in the International Patent Application WO2013/021401 of F. Ili Citterio SpA, the combination of a rigid part, though with a smaller dimension, with a flexible part having larger dimensions allows high trauma but still acceptable values to be reached. Due to the possible elimination of flexible parts, the consequent unacceptable values of trauma should be compensated by introducing additional non ballistic elements, which however would increase the weight.

It is already a well-established trend to use only hard plates that protect from the major risk, although over a smaller surface.

However, while in the soft structure/rigid structure combination the trauma is controlled by the soft structure, where only the rigid structure is used, the trauma induced by the bullet fired from a rifle widely exceeds the prescribed value.

Therefore, it is desirable to provide a ballistic structure, which is capable of ensuring high resistance to piercing and reduced deformation (with resultant trauma), but at the same time, having a limited weight, due to the elimination of non ballistic elements.

OBJECTS OF THE INVENTION

It is an object of the present disclosure to overcome at least some of the problems associated with the prior art.

SUMMARY

The present invention provides a method and a system as set forth in the following claims.

According to the present invention, a ballistic protection is provided, comprising a plurality of separate rigid elements, cooperating and not joint with each other, each of the rigid elements including a plurality of layers of high molecular weight polymers, wherein at least a part of the plurality of layers of high molecular weight polymers of at least one of the rigid elements includes laminates of high molecular weight polyethylene tapes or strips in the form of unidirectional leaves; at least a part of the plurality of layers of high molecular weight polymers of at least one of the rigid elements includes resin-impregnated fibrous laminates made of high molecular weight polyethylene fibers; characterized in that: the weight per unit of surface area of the first rigid element with respect to the direction of the incident bullet is greater than the weight per unit of surface area of the rigid element or rigid elements that follow the first one; and the value of specific bending modulus of the first rigid element with respect to the direction of the incident bullet is smaller than the specific bending modulus of the rigid element or rigid elements that follow the first one.

In a preferred embodiment of the present invention, the weight per unit of surface area of the rigid elements is decreasing starting from the first rigid element with respect to the direction of the incident bullet. Furthermore, advantageously, the value of the specific bending modulus of the rigid elements is increasing starting from the first rigid element with respect to the direction of the incident bullet.

The ballistic protection according to the present invention has the advantage that the structures composed of elements which are poorly performing from the ballistic point of view, such as, for example, elements made of high molecular weight polyethylene strips or tapes, if introduced in non monolithic structures, allow a drastic reduction of the value of trauma without jeopardizing the bullet stopping capability. With a ballistic protection according to a preferred embodiment of the present invention, the value of trauma induced by the bullet impact is at least 20% lower with respect to the value of trauma induced by the bullet to a structure having the same composition, but monolithic. The use of elements which are less performing from the ballistic point of view, brings about another advantage that derives from the cost reduction due to better efficiency in the production of tape or strips as compared with the yarn production costs.

Advantageously, the rigid element including fibrous laminates made of high molecular weight polyethylene fibers is located on the side facing the direction of an incident bullet.

In a preferred embodiment, the laminates of high molecular weight polyethylene tapes or strips in the form of unidirectional leaves are placed in such a way that the unidirectional leaves of one layer are inclined at about 90° with respect to the leaves of the next layer, and the single layers have at least one adhesive-covered face.

According to a preferred embodiment, in order to obtain the necessary rigidity, each element is individually pressed with a pressure between 1 and 300 Bar and at a temperature of between 50° C. and 200° C.

In a preferred embodiment, the textile elements are wholly or partially impregnated with one or more of the following: thermoplastic, thermosetting, elastomeric, viscous or viscoelastic polymers.

Optionally, the ballistic protection includes at least one ceramic element, likewise integrated in a polymeric structure and located outside and before the first rigid element with respect to the direction of the incident bullet.

According to another aspect of the present invention, a ballistic protective article is provided, including the above described ballistic protection.

The present invention allows a ballistic protection structure to be produced with a high resistance to piercing and reduced deformation (with consequent trauma), but at the same time, having a limited weight, by elimination of non ballistic elements.

Furthermore, a protective element according to the invention achieves a trauma reduction without compromising the incident bullets stop capability and, at the same time, allows the protection weight and cost to be reduced.

BRIEF DESCRIPTION OF THE DRAWINGS

These and other advantages, objects and characteristics of the present invention will be better understood by those skilled in the art from the following description and from the enclosed drawings, with reference to non-limiting particular embodiments described by way of illustrative examples, and therefore considered as not limiting its scope, in which.

DETAILED DESCRIPTION OF THE PREFERRED EMBODIMENTS

Reduced to its essential form and with reference to the figures of the enclosed drawings, a ballistic protection for personal protection according to the present invention includes a plurality of rigid structures, separated from one another, in which at least one rigid element includes layering of leaves made by high molecular weight polyethylene tapes arranged in parallel and unidirectional fashion, wherein these leaves are cross-plied and pressed at high temperature with adhesive polymers being laid down on at least one face of the single leaves, and in which at least another rigid element includes a layering of unidirectional resin-impregnated yarns, wherein each layer of unidirectional yarn is crossed with the subsequent one and subjected to a temperature and pressure action. In a preferred embodiment, the rigid structure, which is the first to be impacted by the bullet, is made of a rigid element composed of ultra high molecular weight polyethylene yarn. The values of trauma obtained by the bullet impact are considerably reduced with respect to a monolithic layering of the same weight.

The ballistic protection according to the present invention includes at least two rigid layers, separated, cooperating and not joint one with another. The weight per unit of surface area of the rigid element placed as first on the direction of the incident bullet (i.e. which is the first to be impacted by the bullet) is greater than the weight per unit of surface area of the other subsequent rigid element or elements; the specific bending modulus value of the rigid element, which is the first to be impacted by the bullet, is smaller than the specific bending modulus of the subsequent rigid element or elements.

In one embodiment, the ballistic protection includes at least two separate rigid elements, in which the weight per unit of surface area of the first element, which is impacted by the bullet, is greater than the specific weight per unit of surface area of all the other elements: the specific weight per unit of surface area of the element that follows the first one is comprised between 95% and 5% with respect to the first one.

Figure 1:
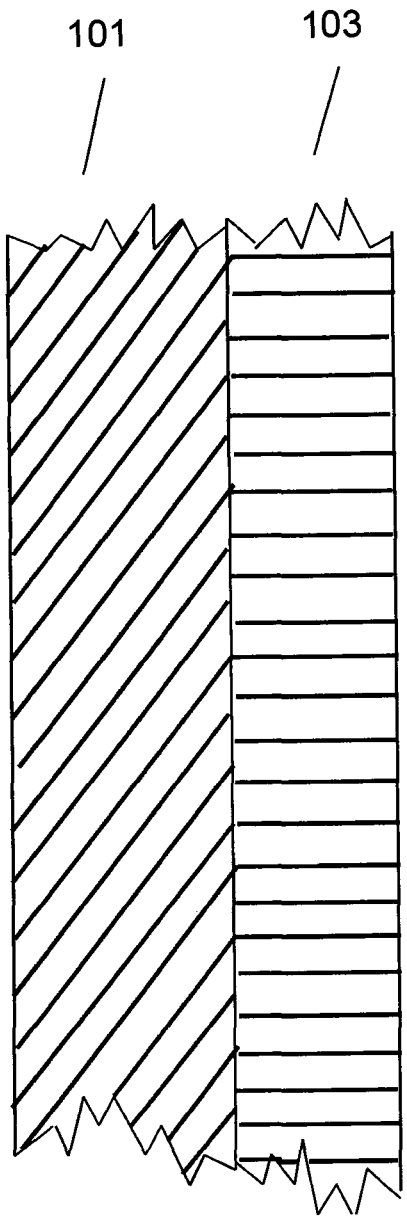
FIG. 1 is a schematic, vertical section view of a structure for making ballistic protections according to a possible embodiment of the present invention.
Figure 2:
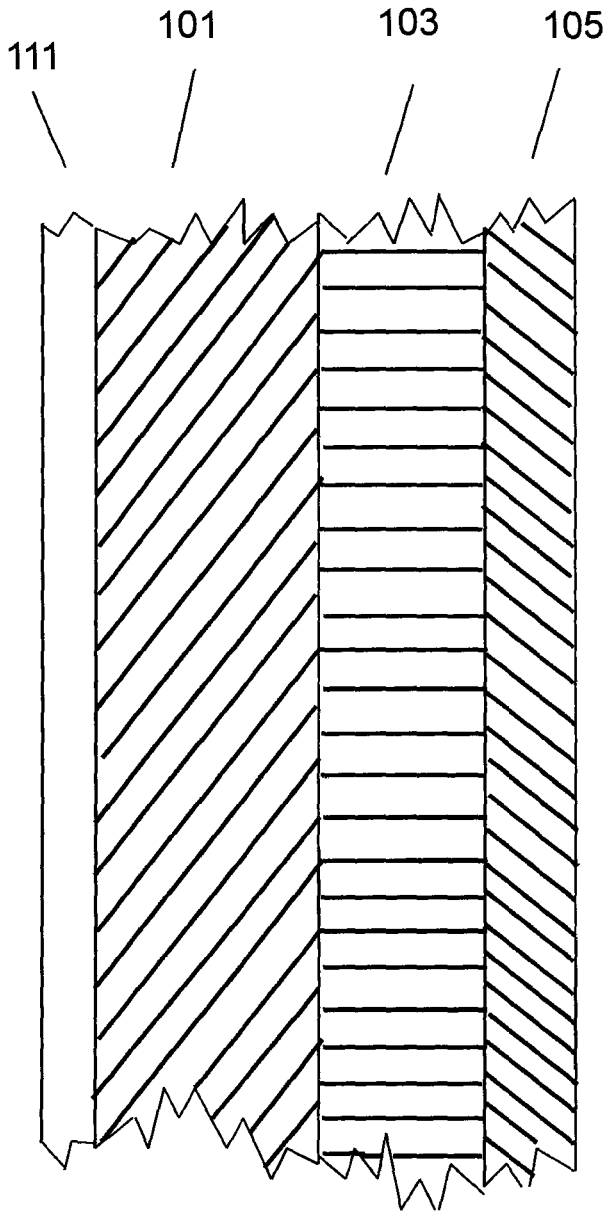
FIG. 2 is a schematic, vertical section view of a structure for making ballistic protections according to a possible alternative embodiment.

FIG. 1 represents a ballistic protection according to an embodiment of the present invention which includes a first rigid element 101 and a second rigid element 103. A possible alternative embodiment, including three rigid elements 101, 103 and 105 is represented in FIG. 2 (FIG. 2 also shows an optional ceramic element which will be discussed in the following).

Preferably, the weight per unit of surface area of the rigid element that follows the first one is between 70% and 20% with respect to the weight per unit of surface area of the first element.

As a result, the thickness of the first element is higher than the thickness of all the others.

In an embodiment including three separate rigid elements, the weight per unit of surface area of the second rigid element is between 95% to 5% of the weight per unit of surface area of the first element, preferably between 70% and 20%; the weight per unit of surface area of the third rigid element is between 95% and 5% with respect to the weight of the first rigid element.

For example, in a solution with three rigid and separate elements, the weight per unit of surface area of the first element is 13 kg/m$^2$, the weight per unit of surface area of the second element is 3.5 kg/m$^2$ and that of the third element is 2.5 kg/m$^2$.

In another possible embodiment of the present invention, with three rigid and separate elements, the weight per unit of surface area of the first element is 13 kg/m$^2$, the weight per unit of surface area of the second rigid element is 1.5 kg/m$^2$ and the weight per unit of surface area of the third rigid element is 3.5 kg/m$^2$.

In a preferred embodiment the specific bending modulus of the rigid element, which is the first to be impacted by the bullet, is at least 10% lower than the specific bending modulus of the subsequent element or elements. With this combination, the smaller bending modulus of the first element, which is the first to be impacted by the bullet, allows the energy to be absorbed by deformation, while higher bending moduli of the subsequent layers control the induced deformation and consequently, the related trauma.

In a preferred embodiment, the specific bending moduli are increasing beginning from the first element up to the last one.

Typical values of the modulus of rigid laminates based on fibrous materials are in the range of 50 to 150 ksi, typical values of specific bending modulus of laminates based on tapes or plates are in the range of 200 to 400 ksi.

In one embodiment of the present invention, the first rigid element is formed by a textile element made of yarns having tensile strength higher than 10 g/den, elongation to rupture higher than 1% and tensile strength modulus higher than 40 GPa. Such first rigid textile element preferably includes UHMW polyethylene fibers, such as, for example, fibers of Spectra® or Dyneema® type, having the molecular weight greater than 500,000. In a preferred embodiment, the molecular weight is higher than 2,000,000 (two million).

These fibers are preferably impregnated with thermoplastic elastomeric resins, for example, of Kraton® type and then laminated to realize a continuous sheet with bidirectional structure, cross-plied, for example at 0°/90° or +/−45°. These laminates include laminates known as, for example, HB50 Dyneema® or Spectra 3137®. Some of these leaves, also mixed as to weight and quality, are superimposed and consolidated with a pressure generally comprised between 1 and 300 Bar and preferably at a temperature in the range of 50 to 200° C.

The forms resulting from such pressing can be flat, with a simple curvature or with a multiple curvature, depending on the specific needs.

The first monolithic element can also include partly fibrous laminates based on ultra high molecular weight PE, in combination with laminates made of tapes or strips made of high molecular weight polyethylene, with laminates made of aramidic, copolyaramidic, polybenzoxazole, liquid crystal fibers, such as, for example, Kevlar®, Twaron®, Artec®, PBO, PBT, Vectran® fibers.

The elements including tapes or strips made of high molecular weight PE include a plurality of layers of unidirectional laminates, then compacted one to another with pressure and temperature with laying angles comprised between 0°/90° and +/−45°.

These layers can be compacted one to another by application of heat and pressure, due to the presence of an adhesive substance on at least one surface.

These tapes or strips, laid unidirectionally, such as, for example, those produced by Teijin under the name Endumax®, have typical thicknesses of 50/60μ, tensile strength from 20 to 26 cN/dtex, an elongation from 1.5 a 2%, modulus higher than 1400 g/dtex and molecular weights higher than 2,000,000.

Such laminates are pressed at temperatures in the range of 50° to 200° C. and at pressures comprised between 1 and 300 Bar.

Similar products are manufactured also by DuPont® under the name of Tensylon® or by DSM® under the name BT10®.

In a possible embodiment, requiring an increased protection against perforation from armour-piercing bullets, in particular reinforced bullets of penetrating type, with cores made of steel having 60 HRC hardness or tungsten carbide based alloys (e.g. 7.62×51AP), one or more ceramic or glass-ceramic elements 111 can be associated to the above described structure (as shown in FIG. 2).

Said ceramic elements 111, which can be realized, for example, from carbide oxides or nitrides based ceramics, can be monolithic or made of juxtaposed ceramic sub-elements. In a preferred embodiment of the present invention the at least one ceramic element is embedded in a polymeric structure.

Such ceramic elements can be in direct contact with the first rigid structure or separated by a discontinuity layer (not shown in FIG. 2).

The ceramic element is generally protected by an additional structure in order to avoid as much as possible a fragmentation of the same element.

Further combinations are possible depending on the desired performance of back face deformation and according to the bullet energy.

For example, in the illustrated examples of the present invention reference has been made to a rigid structure including two or three rigid elements separated one from another. The first of such rigid elements is made (in the shown examples) of fibrous material, while the second and/or the third ones are made of laminates of high molecular weight polyethylene tapes or strips.

However, other embodiments are possible, comprising, for example, more than three elements. Moreover, the first element (the one turned to the bullet incident direction), can include both fibrous layers and laminated layers of high molecular weight polyethylene tapes or strips, or only laminated layers of high molecular weight polyethylene tapes or strips.

In practice, in any case, the realization details can vary in a corresponding way as for single constructive elements described and illustrated and as for the indicated materials nature without departing from the adopted solution concept and consequently, remaining within the scope of the present invention.

It will be appreciated that changes and modifications may be made to the above without departing from the scope of the invention. Naturally, in order to satisfy specific requirements, a person skilled in the art may apply to the above described solution many modifications and changes. Particularly, although the present disclosure has been described with a certain degree of accuracy with reference to preferred embodiments thereof, it should be understood that possible omissions, substitutions and changes in the form and details as well as other embodiments are possible; moreover, it is expressly intended that specific elements and/or steps of the manufacturing method described in connection with any disclosed embodiment of the invention may be incorporated in any other embodiment as a general matter of design choice.

For example, similar considerations apply if the components have different structure or include equivalent units.

EXAMPLES AND TESTS

Comparison tests have been made using known structures and the structures proposed by the present invention, not only for assessing the values of trauma, but also for assessing ballistic limits.

All tests have been made according to the American rules NIJ 0101.04 level III.

Comparative Example 1 (Prior Art Structure)

78 laminated layers of Dyneema HB50 have been pressed at 200 Bar and at 122° C. in order to form a monolithic plate. The plate has been tested to verify the values of trauma induced by the bullet impact

| Bullet type | Speed | Weight kg/m$^2$ | Trauma mm |
|---|---|---|---|
| NATO 7.62X51 | 841 | 18.1 | 60 |

Comparative Example 2 (Prior Art Structure)

56 laminated layers of Dyneema HB50 and 50 layers of Tensylon T30A have been pressed together at 200 Bar and at 122° C. to form a monolithic plate. The plate has been tested to verify the values of trauma induced by the bullet impact

| Bullet type | Speed | Weight kg/m$^2$ | Trauma mm |
|---|---|---|---|
| NATO 7.62X51 | 840 | 18.3 | 64 |

Comparative Example 3 (Prior Art Structure)

48 layers of Dyneema HB50 and 66 layers of Tensylon T30A have been pressed together at 200 Bar and at 122° C. to form a monolithic plate. The plate has been tested to verify the values of trauma induced by the bullet impact

| Bullet type | Speed | Weight kg/m$^2$ | Trauma mm |
|---|---|---|---|
| NATO 7.62X51 | 850 | 18.3 | 50 |

Comparative Example 4 (Prior Art Structure)

66 layers of Tensylon T30A and 48 layers of Dyneema HB50 have been pressed together at 200 Bar and at 122° C. to form a monolithic plate. The plate has been tested to verify the values of trauma induced by the bullet impact

| Bullet type | Speed | Weight kg/m$^2$ | Trauma mm |
|---|---|---|---|
| NATO 7.62X51 | 848 | 18.3 | 55 |

Comparative Example 5 (Prior Art Structure)

93 layers of ENDUMAX SHIELD XF22 have been pressed together at 55 Bar and at 129° C. to form a monolithic plate. The plate has been tested to verify the values of trauma induced by the bullet impact

| Bullet type | Speed | Weight kg/m$^2$ | Trauma mm |
|---|---|---|---|
| NATO 7.62X51 | 848 | 18.7 | 48 |

Example 6 (Structure According to an Embodiment of the Present Invention)

62 layers of Dyneema HB50 have been pressed together at 200 Bar and at 122° C. to form a first plate, 36 layers of Tensylon T30A have been pressed at 95 Bar and at 122° C. to form a second plate.

The combination of these two separate plates has been tested to verify the values of trauma induced by the bullet impact.

| Bullet type | Speed | Weight kg/m$^2$ | Trauma mm |
|---|---|---|---|
| NATO 7.62X51 | 845 | 18.5 | 27 |

Example 7 (Structure According to an Embodiment of the Present Invention)

56 layers of Dyneema HB50 have been pressed together at 200 Bar and at 122° C. to form a first plate, 36 layers of Tensylon T30A have been pressed at 95 Bar and at 122° C. to form a second plate, 18 layers of Tensylon T30A have been pressed at 95 Bar and at 122° C. to form a third plate.

The combination of these three separate plates has been tested to verify the values of trauma induced by the bullet impact.

| Bullet type | Speed | Weight kg/m$^2$ | Trauma mm |
|---|---|---|---|
| NATO 7.62X51 | 842 | 18.8 | 24 |

Example 8 (Structure According to an Embodiment of the Present Invention)

60 layers of Dyneema HB50 have been pressed together at 200 Bar and at 122° C. to form a first plate, 22 layers of Tensylon T30A have been pressed at 95 Bar and at 122° C. to form a second plate, 11 layers of Tensylon T30A have been pressed at 95 Bar and at 122° C. to form a third plate.

The combination of these three separate plates has been tested to verify the values of trauma induced by the bullet impact.

| Bullet type | Speed | Weight kg/m$^2$ | Trauma mm |
|---|---|---|---|
| NATO 7.62X51 | 833 | 17.8 | 26 |

Additional tests have been performed to verify the stopping capability (V50) versus the bullets of the NATO 7.62×51 type, using the NIJ 0101.04 specification, with the following results:

Comparative Example 2 V50=910 m/sec.

Comparative Example 3 V50=905 m/sec.

Example 6 V50=908 m/sec.

Example 8 V50=920 m/sec.

The invention claimed is:

1. A ballistic protection comprising:

a plurality of separate rigid elements, cooperating and not joined with one another, each of the rigid elements comprising a plurality of layers of high molecular weight polymers;

wherein at least a part of the plurality of layers of high molecular weight polymers of at least one of the rigid elements comprises laminates of high molecular weight polyethylene tapes or strips in a form of unidirectional leaves;

wherein at least a part of the plurality of layers of high molecular weight polymers of at least one of the rigid elements comprises resin-impregnated fibrous laminates comprising high molecular weight polyethylene fibers;

wherein a weight per unit of surface area of a first rigid element with respect to a direction of an incident bullet is greater than the weight per unit of surface area of the rigid element or rigid elements that follow the first rigid element;

wherein a value of a specific bending modulus of the first rigid element with respect to the direction of the incident bullet is smaller than the specific bending modulus of the rigid element or rigid elements that follow the first rigid element; and wherein each element of the plurality of rigid elements is individually pressed at a pressure between 1 Bar and 300 Bar and at a temperature in the range of 50° C. to 200° C.

2. The ballistic protection of claim 1, wherein:

the weight per unit of surface area of the rigid elements is decreasing beginning from the first rigid element with respect to the direction of the incident bullet; and the value of the specific bending modulus of the rigid elements is increasing beginning from the first rigid element with respect to the direction of the incident bullet.

3. The ballistic protection of claim 1, wherein the first rigid element comprises fibrous laminates made of high molecular weight polyethylene yarns impregnated with thermoplastic, thermosetting, elastomeric, viscous, or viscoelastic polymers.

4. The ballistic protection of claim 1, wherein the first rigid element comprises laminates based on tapes or strips of high molecular weight polyethylene.

5. The ballistic protection of claim 1, wherein the fibers of the fibrous laminates include at least one of the following materials: UHMW polyethylene fibers, aramidic, co-polyaramidic, so-polyaramidic, polybenzoxazole, polybenzotiazole, and liquid crystal fibers.

6. The ballistic protection of claim 1, wherein the laminates of high molecular weight polyethylene tapes or plates in the form of unidirectional leaves are placed in such a way that the unidirectional leaves of one layer are inclined at about 90° with respect to the leaves of the next layer.

7. The ballistic protection of claim 1, wherein the layers that form the laminates of high molecular weight polyethylene tapes or strips have at least one adhesive-covered face.

8. The ballistic protection of claim 1, in which the weight per unit of surface area of one rigid element is comprised between 95% and 5% of the weight per unit of surface area of a preceding rigid element.

9. The ballistic protection of claim 1, in which the weight per unit of surface area of one rigid element is between 70 and 20% of the weight per unit of surface area of a preceding rigid element.

10. The ballistic protection of claim 1, wherein the specific bending modulus of one rigid element is at least 10% higher than the specific bending modulus of a preceding rigid element.

11. The ballistic protection of claim 1, comprising three separate rigid elements, cooperating and not joint one with another.

12. The ballistic protection of claim 1, comprising at least one ceramic element also embedded in a reinforced polymeric structure situated outside and before the first rigid element with respect to the incident bullet direction.

13. A ballistic protective article comprising:

a ballistic protection;

wherein the ballistic protection comprises:

a plurality of separate rigid elements, cooperating and not joined with one another, each of the rigid elements comprising a plurality of layers of high molecular weight polymers;

wherein at least a part of the plurality of layers of high molecular weight polymers of at least one of the rigid elements comprises laminates of high molecular weight polyethylene tapes or strips in a form of unidirectional leaves;

wherein at least a part of the plurality of layers of high molecular weight polymers of at least one of the rigid elements comprises resin-impregnated fibrous laminates comprising high molecular weight polyethylene fibers;

wherein a weight per unit of surface area of a first rigid element with respect to a direction of an incident bullet is greater than the weight per unit of surface area of the rigid element or rigid elements that follow the first rigid element;

wherein a value of a specific bending modulus of the first rigid element with respect to the direction of the incident bullet is smaller than the specific bending modulus of the rigid element or rigid elements that follow the first rigid element; and wherein each element of the plurality of rigid elements is individually pressed at a pressure between 1 Bar and 300 Bar and at a temperature in the range of 50° C. to 200° C.

* * * * *